US005172430A

United States Patent [19]

Lerma-Solis

[11] Patent Number: 5,172,430

[45] Date of Patent: Dec. 22, 1992

[54] CONDOM POCKET UNDERWEAR

[76] Inventor: Natalie A. Lerma-Solis, 1112 Prospector Dr., Stockton, Calif. 95210

[21] Appl. No.: 791,356

[22] Filed: Nov. 14, 1991

[51] Int. Cl.[5] ..... A41B 9/00; A61F 6/02; B65D 85/08

[52] U.S. Cl. ..... 2/400; 2/403; 2/406; 206/69; 128/842; 128/844

[58] Field of Search ..... 2/238, 247, 400, 403, 2/842, 844, 67, 406, 250–253; 128/78, 79; 604/385.1, 396, 360; 206/69

[56] References Cited

U.S. PATENT DOCUMENTS

| | | | |
|---|---|---|---|
| 2,544,840 | 3/1951 | Kowatsch | 2/67 |
| 3,871,030 | 3/1975 | Green | 2/250 |
| 4,808,175 | 2/1989 | Hansen | 604/385.1 |
| 5,005,695 | 4/1991 | Tennefos et al. | 206/69 |
| 5,067,178 | 11/1991 | Katchka | 2/247 |
| 5,093,935 | 4/1992 | Countee, Jr. | 2/400 |

FOREIGN PATENT DOCUMENTS

| | | | |
|---|---|---|---|
| 2143422 | 2/1985 | United Kingdom | 2/400 |

*Primary Examiner*—Randall L. Green
*Assistant Examiner*—A. P. Zuttarelli
*Attorney, Agent, or Firm*—Leon Gilden

[57] ABSTRACT

An underwear garment includes a torso surrounding web formed with an elastomeric waistband to include a respective first and second leg opening divided by a central crotch web. A pocket member is mounted to the torso web to position a condom member therewithin. A modification of the invention includes a second pocket member spaced from a first pocket member defined by a fluid impermeable pocket structure including a zipper seam to permit depositing of a condom member therewithin, wherein the second pocket is arranged to include a tube member including a germicidal fluid that is punctured upon projection and securement of the zipper seam together directing germicidal fluid through a distribution conduit positioned below the tube member in communication with the second pocket cavity.

2 Claims, 4 Drawing Sheets

CONDOM POCKET UNDERWEAR

BACKGROUND OF THE INVENTION

1. Field of the Invention

The field of invention relates to undergarment structure, and more particularly pertains to a new and improved condom pocket underwear wherein the same is arranged for the securement of a condom member within a pocket of the underwear garment.

2. Description of the Prior Art

The advent of sexually transmissive diseases in contemporary society requires the utilization of various precautions to prevent spread of disease. The instant invention provides for advantages over the prior art by utilizing a pocket member integrally formed relative to an undergarment structure in combination with a condom positioned therewithin for ease of access thereto. Prior art undergarment construction is exemplified to accommodate various activity such as U.S. Pat. No. 4,870,958 to Webster wherein an underwear member utilizes a partitioning liner to maintain an undergarment in position during various physical activities.

U.S. Pat. No. 4,702,239 to Ichikawa sets forth an undergarment member for men, including a hip covering portion covering a user's hips to further include a crotch covering portion of predetermined configuration.

As such, it may be appreciated that there continues to be a need for a new and improved condom pocket underwear as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of underwear construction now present in the prior art, the present invention provides a condom pocket underwear wherein the same is arranged to position a condom member within a pocket structure of an associated underwear garment. As such, the general purpose of the present invention, which will be described subsequently in greater detail, is to provide a new and improved condom pocket underwear which has all the advantages of the prior art underwear construction and none of the disadvantages.

To attain this, the present invention provides an underwear garment including a torso surrounding web formed with an elastomeric waistband to include a respective first and second leg opening divided by a central crotch web. A pocket member is mounted to the torso web to position a condom member therewithin. A modificaition of the invention includes a second pocket member spaced from a first pocket member defined by a fluid impermeable pocket structure including a zipper seam to permit depositing of a condom member therewithin, wherein the second pocket is arranged to include a tube member including a germicidal fluid that is punctured upon projection and securement of the zipper seam together directing germicidal fluid through a distribution conduit positioned below the tube member in communication with the second pocket cavity.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved condom pocket underwear which has all the advantages of the prior art underwear construction and none of the disadvantages.

It is another object of the present invention to provide a new and improved condom pocket underwear which may be easily and efficiently manufactured and marketed.

It is a further object of the present invention to provide a new and improved condom pocket underwear which is of a durable and reliable construction.

An even further object of the present invention is to provide a new and improved condom pocket underwear which is susceptible of a low cost of manufacture with regard to both materials and labor, and which accordingly is then susceptible of low prices of sale to the consuming public, thereby making such condom pocket underwear economically available to the buying public.

Still yet another object of the present invention is to provide a new and improved condom pocket underwear which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
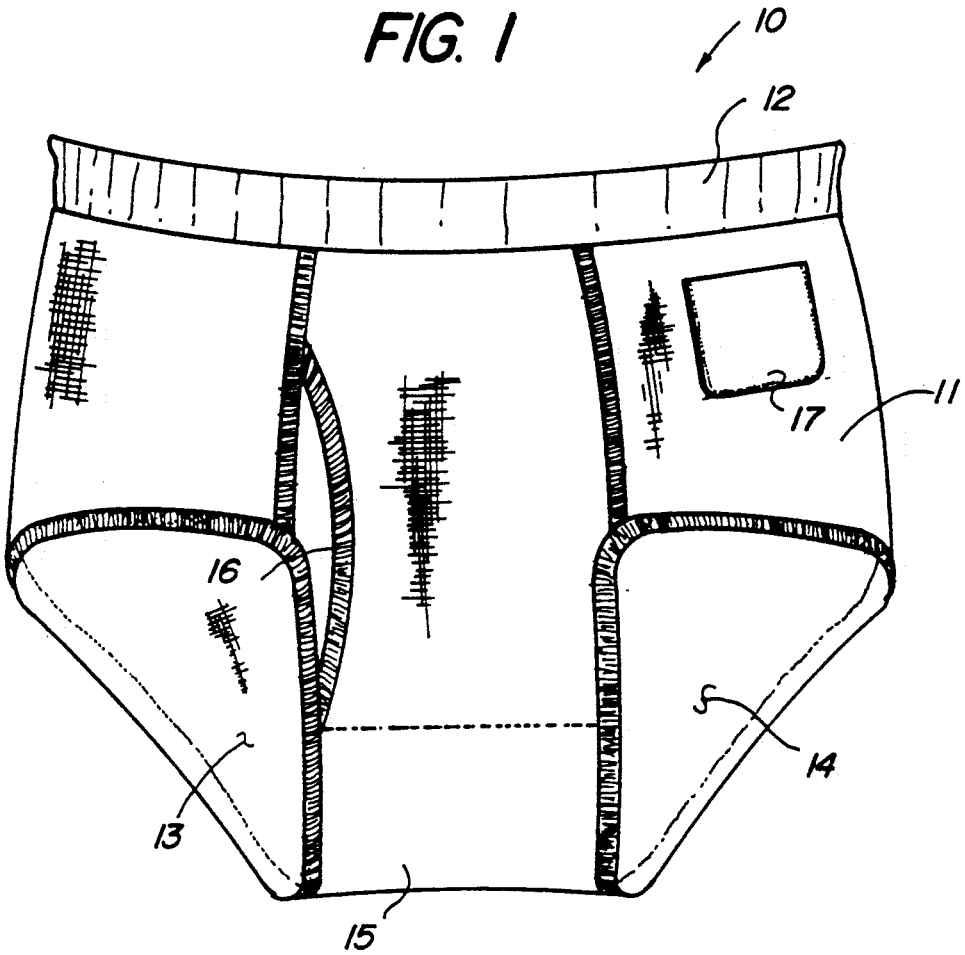
FIG. 1 is an orthographic frontal view, taken in elevation, of a man's underwear garment.

With reference now to the drawings, and in particular to FIGS. 1 to 8 thereof, a new and improved condom pocket underwear embodying the principles and concepts of the present invention and generally designated by the reference numerals 10 and 10*a* will be described.

Figure 2:
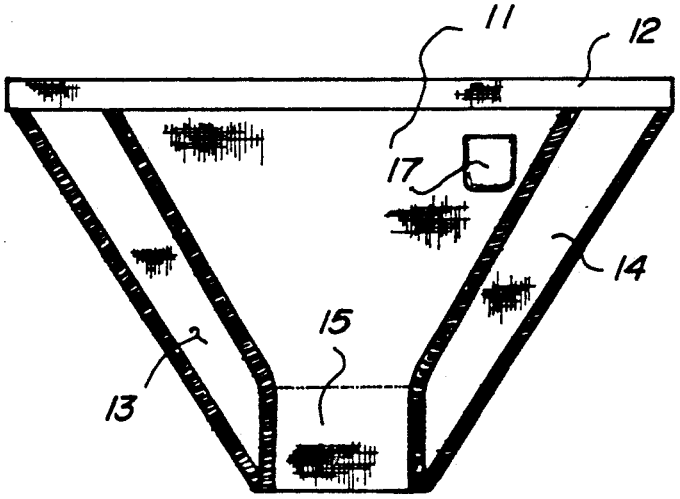
FIG. 2 is an orthographic illustration of the instant invention configured as a woman's underwear garment.
Figure 3:
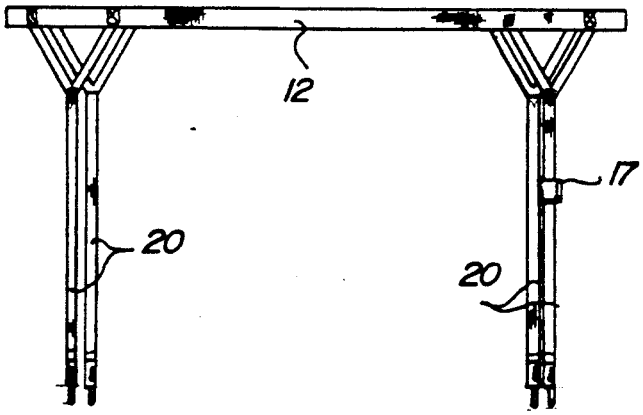
FIG. 3 is an orthographic elevational view of the invention configured as a hose support garment for use by women.

More specifically, the condom pocket underwear 10 of the instant invention essentially comprises a torso surrounding web 11 including an annular elastomeric waistband 12 fixedly mounted to an upper perimeter end of the torso web 11 to provide access into the underwear member 10. A first leg opening 13 and a second leg opening 14 are directed through the torso web 11 demarcated by a crotch web 15. As illustrated in FIGS. 1 and 2, the garment may be configured as either a man's or woman's underwear garment respectively, including a pocket member 17 mounted to the torso web 11 adjacent the waistband defined by a pocket member cavity 18 including a condom member 19 contained therewithin. As a man's underwear garment, as illustrated in FIG. 1, a crotch web opening flap 16 is provided. It should be further noted that should the use of an elastomeric band 12 be utilized individually with a plurality of waistband stocking support tethers 20, the pocket 17 may be mounted to one of the tethers such as in the FIG. 3.

Figure 4:
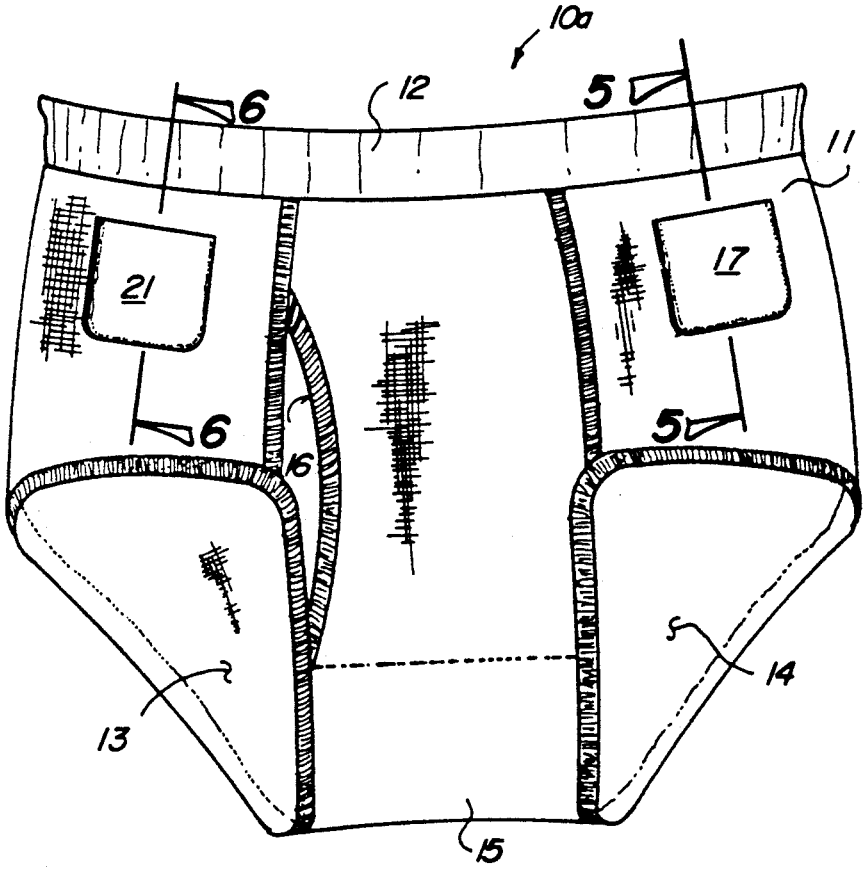
FIG. 4 is an orthographic view, taken in elevation, of a modification of the invention.
Figure 5:
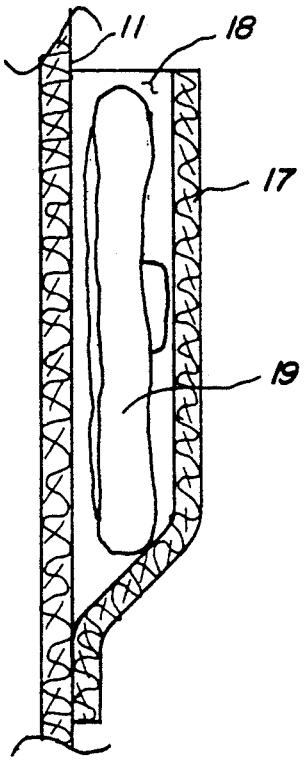
FIG. 5 is an orthographic view, taken along the lines 5—5 of FIG. 4 in the direction indicated by the arrows.
Figure 6:
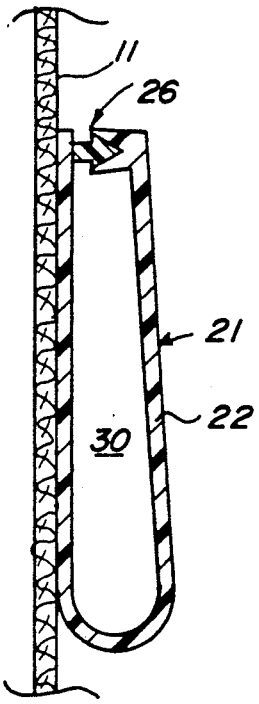
FIG. 6 is an orthographic view, taken along the lines 6—6 of FIG. 4 in the direction indicated by the arrows.
Figure 7:
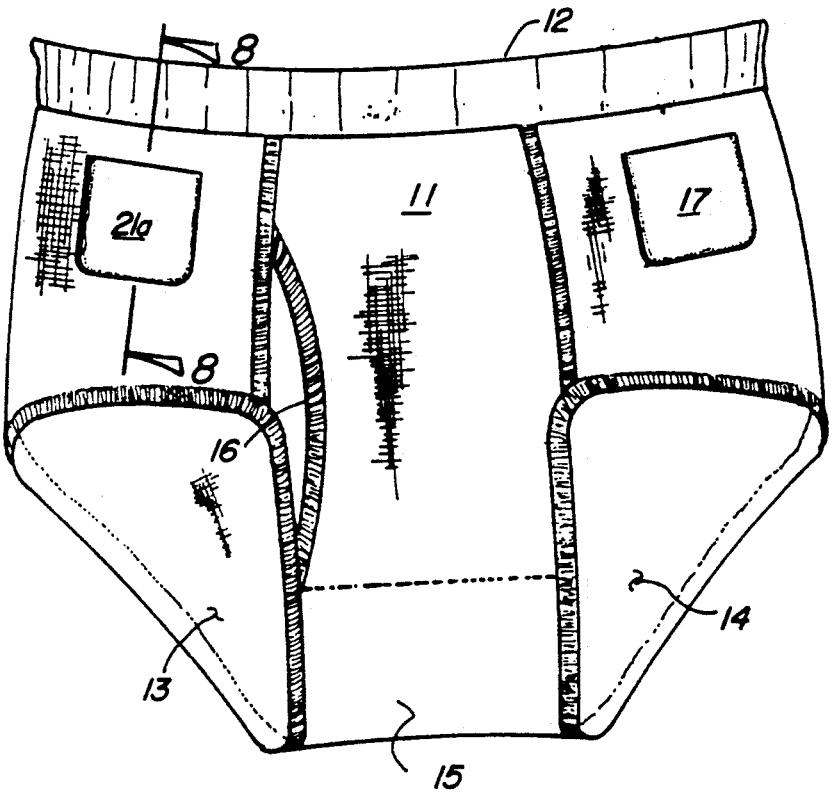
FIG. 7 is an isometric illustration of a further modification of the invention.
Figure 8:
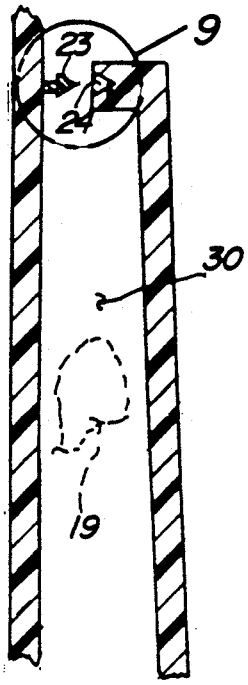
FIG. 8 is an orthographic view, taken along the lines 8—8 of FIG. 7 in the direction indicated by the arrows.
Figure 9:
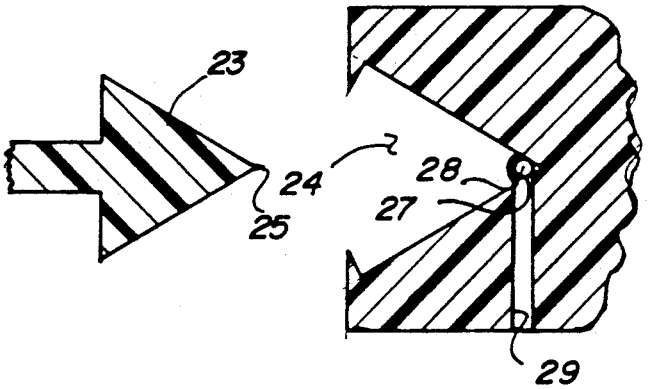
FIG. 9 is an orthographic cross-sectional illustration of section 9, as set forth in FIG. 8.

A modified aspect of the invention as illustrated in FIG. 4 and set forth by the construction 10*a* includes a second pocket 21 mounted to the torso web 11 adjacent the waistband for ease of access thereto, wherein the second pocket 21 (see FIG. 6) is defined by a second pocket cavity 30. The second pocket 21 is formed by a generally "U" shaped fluid impermeable web 22 formed with a single uppermost opening that is selectively closed by an associated zipper opening seam 26. The zipper seam 26 includes a "V" shaped zipper projecting seam 23 mounted to an upper first end of the opening receivable within a "V" shaped zipper cavity 24 that is coextensive therewith. The "V" shaped zipper projecting seam 23 is formed with projecting seam tip 25 (see FIG. 9) that may be formed in a manner as set forth in the FIG. 9 for the selective piercing of a tube member 27 positioned and fixedly mounted within an apex of the "V" shaped cavity 24. The tube member 27 is filled with a germicidal fluid 28 for distribution upon a condom member that is subsequently placed within the second pocket 21. The tube member 27 is positioned above a distribution conduit 29 in fluid communication with the tube member 27 and the underlying second pocket cavity 30 to deposit the germicidal fluid 28 within the cavity 30 and an associated condom member positioned therewithin upon projection of the seam tip 25 into the tube member 27 forcing the germicidal fluid 28 through the distribution conduit 29 and into the second pocket cavity 30 for a sanitary disposing of the condom member 19.

It should be noted that the second pocket 21 may be opened and its contents emptied and washed in a conventional manner for the sanitizing of the pocket for subsequent use, wherein a replacement tube member 27 and associated germicidal fluid 28 contained therewithin may be readhered within the apex of the "V" shaped cavity 24.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An underwear garment comprising, a torso surrounding web, the torso surrounding web including an upper terminal continuous edge, and an annular elastomeric waistband fixedly mounted to the upper continuous edge, and the torso web defining a first leg opening spaced from a second leg opening and including a crotch web positioned between the first leg opening and the second leg opening mounted to the torso surrounding web, and the torso web having a forward panel, a pocket member for receiving a condom member in a first condition mounted to the torso web at the forward panel of the torso web adjacent the elastomeric waistband for ease of access to the pocket member, the pocket member including a pocket member cavity defined between the pocket member and the forward panel of the torso web, and a second pocket for receiving said condom member in a second condition positioned in a spaced relationship relative to the pocket member, wherein the second pocket is formed of a "U" shaped fluid impermeable web for deposit of the condom member in said second condition therewithin, and the second pocket includes a zipper opening seam formed at an opening of the second pocket, wherein the zipper opening seam includes a "V" shaped zipper projecting seam coextensively with a "V" shaped cavity to receive the "V" shaped zipper projecting seam to effect selective interlocking of the zipper projecting seam within the zipper cavity, and the zipper projecting seam includes a projecting seam tip, and the zipper cavity includes an apex portion of an innermost portion of the "V" shaped zipper cavity, and a tube member mounted within the apex portion, the tube member including a germicidal fluid contained therewithin whereupon projection of the seam tip into the apex portion, the tube member is ruptured to effect distribution of the germicidal fluid within the second pocket.

2. A garment as set forth in claim 1 including a distribution conduit formed within the zipper opening seam in fluid communication with the tube member, and the second pocket defining a second pocket cavity below the zipper opening seam within the "U" shaped fluid impermeable web, and the distribution conduit positioned above the second pocket cavity to effect distribution of the germicidal fluid within the second pocket cavity upon rupturing the tube member by the projecting seam tip.

* * * * *